United States Patent [19]

Hall et al.

[11] 4,146,660

[45] Mar. 27, 1979

[54] CORRUGATED CARDBOARD CHIP INSULATION

[76] Inventors: David M. Hall, 790 North St., Randolph, Mass. 02368; Robert F. Russell, 19 Ledge Hill Rd., Weymouth, Mass. 02188

[21] Appl. No.: 851,614

[22] Filed: Nov. 14, 1977

[51] Int. Cl.[2] ..... B65D 71/00; B32G 1/10

[52] U.S. Cl. ..... 428/2; 428/177; 428/182

[58] Field of Search ..... 52/404, 743; 428/2, 428/182, 326, 171, 4

[56] References Cited

U.S. PATENT DOCUMENTS

| | | | |
|---|---|---|---|
| 2,113,128 | 4/1938 | Cunnington | 428/171 |
| 3,664,076 | 5/1972 | McCoy | 428/2 X |
| 3,741,863 | 6/1973 | Brooks | 428/2 X |
| 3,763,621 | 10/1973 | Klein et al. | 428/2 X |
| 3,819,456 | 6/1974 | Enfield | 428/2 X |
| 3,949,036 | 4/1976 | Nelson | 428/2 X |
| 3,956,541 | 5/1976 | Pringle | 428/2 |
| 4,045,603 | 8/1977 | Smith | 428/2 |

*Primary Examiner*—Davis T. Moorhead

[57] ABSTRACT

Insulation comprising a multiplicity of small chips of corrugated cardboard. The chips have varying external configurations and varying orientation of the long axis of the flute(s) with a side of the chip. The chips may be utilized as loose, bagged or block insulation.

7 Claims, 9 Drawing Figures

CORRUGATED CARDBOARD CHIP INSULATION

BACKGROUND OF THE INVENTION

Low cost methods of efficiently disposing of waste materials are a serious problem in most industrial nations of the world. This problem is particularly acute in heavily populated areas.

Landfills and incinerators have and are utilized to dispose of waste materials. Landfills are frequently located at a distance from areas which produce large amounts of waste and therefore are extremely expensive to use and are rapidly filled. Incineration creates air pollution, requires heavy initial capital expenditures and consume great amounts of fuel in order to burn the waste material. Also, they often destroy the waste materials which may have value.

A type of corrugated cardboard or as it is sometimes called corrugated board has been used in this country for making shipping containers since 1895. Today such materials are used extensively for shipping a multitude of commercial items. There are very few items that at one time or another have not been packed in corrugated cardboard containers, whether as raw material destined to the factory or as a finished product destined to the store or customer.

Once the shipped items have arrived at their destination, the corrugated cardboard shipping containers are often discarded. These discarded boxes comprise 10–15 percent of total disposable waste material.

The current method of disposing of the used corrugated boxes is to break them down and pile them into a flat package, then transport them to an incinerator or a landfill. The boxes are particularly clumsy to handle because of their great bulk. Furthermore, until the present invention, there has been no economical, large scale method of recycling or reusing corrugated cardboard known to the inventors.

Corrugated cardboard is made in production widths generally ranging from 60 to 85 inches. The corrugating medium, a web of paperboard, is heated and moistened by a steam shower and then fluted by passage between a pair of rollers.

After fluting, the tips of the flutes are glued to an inner liner or single face of paperboard. This method produces a single face sheet of corrugated cardboard. To produce the more common double faced corrugated cardboard found in boxes, an outer sheet or outer liner of paperboard is adhered to the tips of the flutes on the opposite side from the inner liner of the single faced board. The corrugated board is then scored and cut parallel to its length by a slitter and then cut to proper length by a cut-off knife. The normal direction of the flutes is from top to bottom of a container when it is used to form a box.

Unlike paper waste which has commercial value due to its adaptability in recycling, corrugated cardboard waste has almost no commercial value, except to the trash collectors who are paid to dispose of it.

Corrugated cardboard containers are one of the biggest producers of waste materials in American commerce and industry today. They are expensive to manufacture, used only once, and then discarded.

Another problem also existing at this time is the rapid consumpton of fuels which have caused their depletion and a world wide shortgage, followed by ever upward accelerating cost of their procurement. A very successful method of reducing the use of fuels when used in the heating of structures is to insulate the structures, thereby reducing heat loss and fuel consumption.

SUMMARY OF THE INVENTION

This invention is directed at insulation composed of a multiplicity of small pieces or chips of corrugated cardboard. Each of the pieces include inner and outer liners having a flute portion between and attached to the liners, and may have various configurations including rectilinear and circular types. Each of the pieces may also have the long flute axis oriented in various ways with the sides of the piece. The chips may be used either in a loose pack, sealed within a bag as bag insulation, or they may be lightly compressed together with adjacent chips and adhered to each other to form a block.

DESCRIPTION OF THE DRAWINGS

These and other objects and advantages of the invention will be understood more fully from the following detailed description thereof, with reference to the accompanying drawings wherein.

DESCRIPTION OF THE PREFERRED EMBODIMENTS

Figure 1:
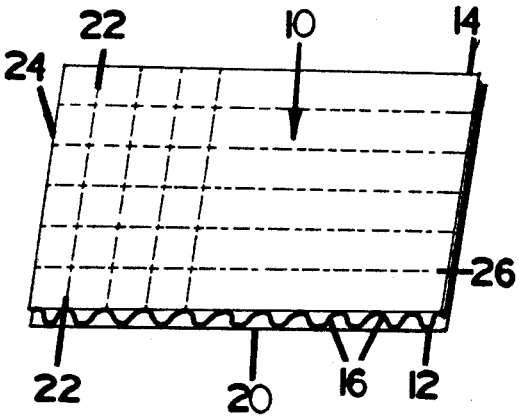
FIG. 1 is a perspective view of a sheet of corrugated cardboard showing the lines of cut, in phantom, used to produce a type of chip.
Figure 2:
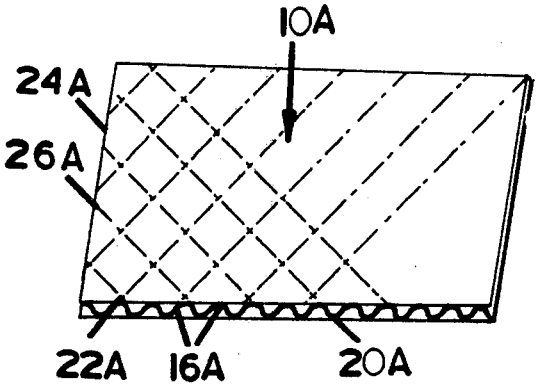
FIG. 2 is a perspective view of a sheet of corrugated cardboard showing the lines of cut, in phantom, used to produce another type of chip.
Figure 3:
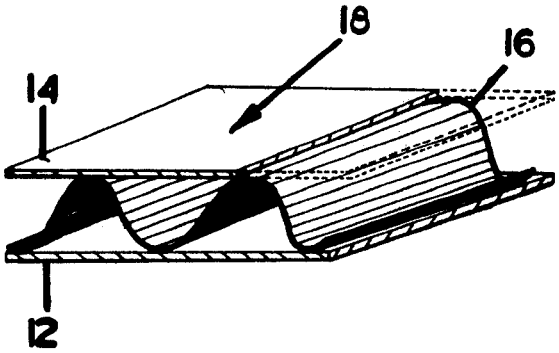
FIG. 3 is a perspective sectional view with a portion of the outer liner removed, of a chip configuration.
Figure 4:
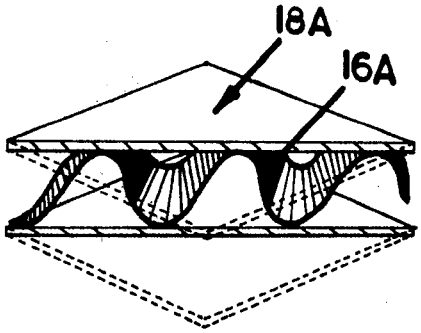
FIG. 4 is a perspective sectional view of a variation of the chip configuration of FIG. 3.
Figure 5:
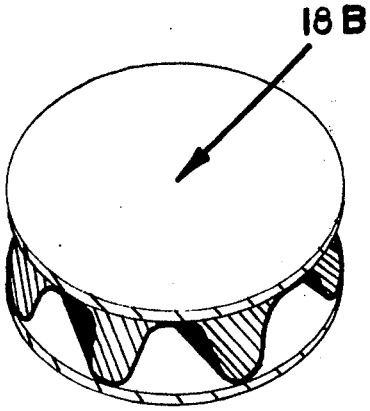
FIG. 5 is a perspective view of a chip having a circular configuration.
Figure 6:
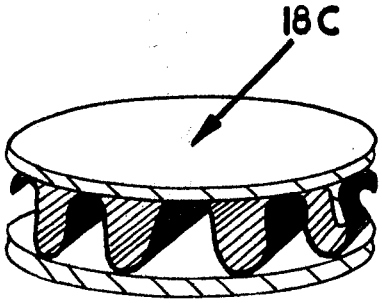
FIG. 6 is a perspective view of a chip having an elliptical configuration.
Figure 7:
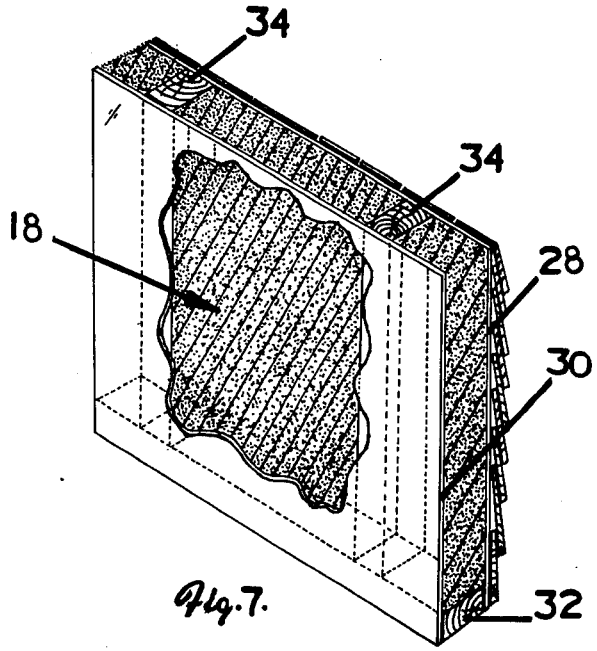
FIG. 7 is a perspective sectional view of a portion of a building wall insulated with the chips of the invention.
Figure 8:
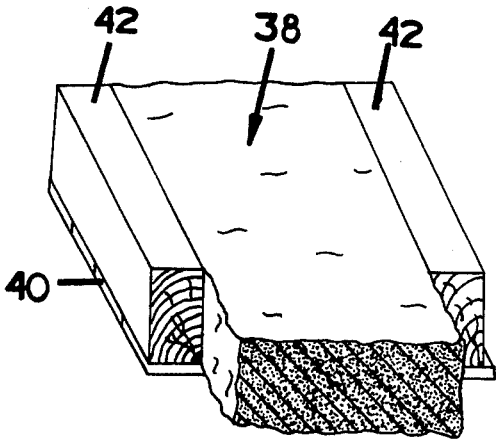
FIG. 8 is a perspective sectional view of a portion of an attic floor insulated with bag insulation containing the chips of the invention.
Figure 9:
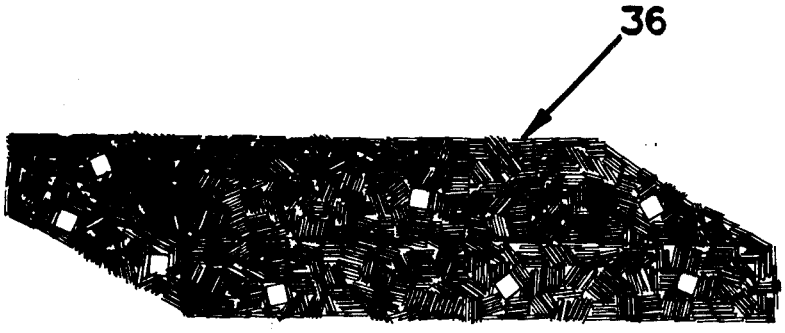
FIG. 9 is a perspective of a block of insulation formed from the adhering together of the chips of the invention.

Corrugated board may be single face comprising an inner liner and corrugating medium adhered to a side of the inner liner; double face 10 comprising corrugating medium sandwiched between and adhered to an inner liner 12 and an outer liner 14; double wall comprising a double face construction having a second layer of corrugating medium adhered to and sandwiched between the outer liner of the double face construction and a liner and triple wall.

The corrugating medium is sinuous in configuration including a series of parallel flutes 16.

The chips or insulating elements 18 are formed from double faced corrugated board that is unused or that has been used as, for example, in forming a shipping container. The containers are cut apart to provide flat, undamaged portions. In the average container, the usable portions may include side and end panels, and the outer and inner flaps. The container portions may then be cut in a number of different ways to provide the chips 18.

One method of cutting or slicing may start with a first cut 22 from a long edge 20 through the middle of the second complete flute from the side edge 24 through the opposite long edge of the corrugated board. The rest of the cuts 22 are made to include a flute 16 as indicated in FIG. 1. The first cut 22 is made at right angles to the long edge 20 of the board across the full width of the board. In the embodiment shown in the drawings, the longitudinal or long axis of the flutes 16 are in right angle relation to the long edge 20. There is the possibility that the flutes would be in right angle relationship to the side edge 24 and in that case the first cut would be made in the second complete flute from the long edge 20 at right angles to the side edge 24 and across the full length of the board.

A second cut 26 is then made at right angles to and across the line of the first cut 22 from the side edge 24 a predetermined distance from the long edge 20 to provide the rectalinear chips 18. The rest of the cuts 26 are made an equal distance from each other and each of these distances is equal to the distance from the long edge 20 to the first of the second cuts 26. The chip 18 includes a portion of the inner and outer liners 12, 14 and at least a portion of one flute 16. Obviously, position of the first cut 22 may be varied to provide portions of two or more flutes in the chip 18 is desired. Further cuts are then made in a manner similar to the first and second cuts.

Another method of cutting is to make the first cut **22*a* at an angle of 45° to the long edge 20*a* of a board from the center of the second flute from the side or short edge 24*a* of the board. A second cut 26*a* is made from the side edge 24*a* and the long edge 20*a* at a 45° angle with the side edge 24*a* and long edge 20*a* and at a 90° angle with and across the first cut 22*a* to provide a square configured chip 18*a*. The pieces formed by the cutting operation adjacent the edges of the board will probably not form complete chips. These may be discarded. In the square configured chip 18*a*, the long axis of the flute 16*a* is at a 45° angle with the edges of the chip 18*a*** that it opens upon.

The cuts may be varied to provide different angular relationship between the flute long axis and the chip edge.

In either the rectalinear or square configuration, the first and second cuts may be made to provide a chip having the length of each of its sides not less than ¼ inch nor more than 3 inches. These dimensions are considered by the inventors to provide optimum insulating advantages when the chips are packed as will be explained more fully hereinafter. The first, second and additional cuts may be simultaneously made by tools having multiple blades appropriately dimensioned according to the desired size of the chip.

Still another method of forming the chips is to form them of circular configuration as a chip **18*b* by punching them out of the corrugated board by methods well known in the art. The chips may also have an elliptical configuration 18*c***. As is true of all the chip embodiments, care should be taken that a substantially undamaged flute portion is provided.

The air space created by the combination of a flute portion and liner portion is an important element for furnishing the insulating quality of the chip.

When used as insulation, the chips are effective as thermal insulators, sound insulators and vibration insulators and can be utilized in many forms of insulation, for example, bag, loose and block.

The chips **18, 18*a*, 18*b* and 18*c* can be manufactured into a block form by spraying, brushing or roll coating their external surfaces with an adherent such as thermal marine glue. The coated chips are placed into a mold manually or by blowing. They are then lightly pressed together and the adherent is allowed to set. If the mold was a large one, the formed piece (sheet) is cut into sections 36**, which may be attached or laid in place in the conventional manner to provide an insulating layer in building construction. The placement may be in areas similar to those where the loose or bagged chips are used as will be set out hereinafter.

In building construction, the loose chips 18 are used, for example, to insulate an exterior wall of an existing wooden building by blowing them, by methods well known in the art, between the sheathing 28 and the lath 30. Of course, the blown chips will also be located on top of the sill 32 and between the studs 34. The chips may also be blown into bags 38, which are subsequently sealed and used as insulators in the walls and attics of dwellings, in a manner well known in the art, such as on a ceiling 40 between joists 42. The chips 18 when used either in a loose pack, bag or block form should be packed with adjacent chips 18 in abutting relation.

What we claim is:

1. Insulation comprising a multiplicity of small corrugated cardboard chips, wherein each chip comprises a flute portion positioned between and attached to a portion of an inner and outer liner, the liner and outer liners in parallel relation to each other.

2. The insulation as set forth in claim 1 wherein each chip is rectilinear in configuration.

3. The insulation as set forth in claim 1 wherein each chip is circular in configuration.

4. The insulation as set forth in claim 1 wherein each chip is elliptical in configuration.

5. The insulation as set forth in claim 1 wherein the flute includes a long axis and the chip having an edge, the flute opening at the edge and the axis forming an angle of less than 90° with the edge.

6. The insulation as set forth in claim 2 wherein the flute includes a long axis and the chip including an edge and the long axis being at a 45° angle to the edge.

7. The insulation as set forth in claim 1 wherein each chip having at least one chip adjacent to it, the adjacent chips adhered to each other.

* * * * *